United States Patent [19]

Hayashi et al.

[11] 4,376,816

[45] Mar. 15, 1983

[54] METHOD FOR STORING SHEETS OF PHOTOTHERMOGRAPHIC SHEET MATERIAL

[75] Inventors: Yoshio Hayashi; Akira Onuma; Tetsuo Shiga, all of Fuji, Japan

[73] Assignee: Asahi Kasei Kogyo Kabushiki Kaisha, Osaka, Japan

[21] Appl. No.: 276,870

[22] Filed: Jun. 25, 1981

[30] Foreign Application Priority Data

Jul. 4, 1980 [JP] Japan ..... 55-91289

[51] Int. Cl.[3] ..... G03C 5/24; B65B 35/50; B65D 85/48

[52] U.S. Cl. ..... 430/347; 430/617; 430/644; 206/455; 53/447; 53/459; 53/474

[58] Field of Search ..... 206/455; 430/617–620, 430/644, 538, 501, 961, 347; 282/27.5; 53/459, 447, 474

[56] References Cited

U.S. PATENT DOCUMENTS

| | | | |
|---|---|---|---|
| 2,158,173 | 5/1939 | Baxter | 430/501 |
| 2,327,713 | 8/1943 | Hunter | 206/455 |
| 2,354,706 | 8/1944 | Rulon | 206/455 |
| 3,933,508 | 1/1976 | Ohkubo et al. | 430/620 |

FOREIGN PATENT DOCUMENTS

| | | | |
|---|---|---|---|
| 232604 | 1/1926 | United Kingdom | 206/455 |

*Primary Examiner*—Mary F. Downey
*Attorney, Agent, or Firm*—Sprung, Horn, Kramer & Woods

[57] ABSTRACT

A method for storing sheets of a photothermographic sheet material composed of a high molecular weight compound support and a sensitive emulsion comprising, as the indispendable constituents, an organic silver salt oxidizing agent, a reducing agent for silver ion, a photosensitive silver salt compound or its precursor, and a binder, characterized by inserting paper having smooth surfaces between every two sheets of said photothermographic sheet material. By this method, the photothermographic sheet material can be stored for a long period of time without deterioration of quality.

15 Claims, No Drawings

METHOD FOR STORING SHEETS OF PHOTOTHERMOGRAPHIC SHEET MATERIAL

This invention relates to a method for storing sheets of a photothermographic sheet material, which is of thermo-development type, without deterioration of their qualities.

Thermo-development type sheet materials containing silver salts are expected to be utilized in various fields because of their simplicity and rapidity in development, but have various problems to be solved.

One of the problems to be solved is the storage stability. Conventionally known photothermographic sheet materials undergo, during storage, bleeding and/or blooming or dusting phenomena wherein their constituents are deposited on the surface, so that their photographic characteristics are deteriorated. The main cause of the bleeding and/or blooming or dusting phenomena is thought to be the lack of compatibility of the constituents with one another. In order to remedy this problem, there have been proposed, for example, a method by which an internal protective layer is formed on the upper layer of the sensitive emulsion; a method by which a polymer layer for preventing the invasion of the air is formed on the back side of each sheet of a photographic substrate and the sheets of the photographic substrate are arranged so that the sensitive emulsion layer of each of the sheets of the photographic substrate is allowed to face the polymer layer of another sheet and the resulting assemblies are laminated under pressure and stored (Japanese Patent Kokai (Laid-Open) No. 43130/76).

However, although these methods may be effective for the storage for a short period of time, they are not effective for the storage for as long a period of time as more than half a year and hence cannot be said to be practical. Furthermore, these methods have caused great inconvenience in handling the sheet materials when using them, because the sheet materials have to be stored in the state that they are laminated under pressure.

The present inventors have conducted extensive research for the purpose of developing a storage method which is simple, can keep the qualities of sheet materials unchanged even in the case of storage for a long period of time and enables the sheet thus stored to be easily handled in actual use. As a result, it has been found that the purpose can surprisingly be achieved by inserting paper having smooth surfaces between every two sheets of the photothermographic sheet materials.

According to this invention, there is provided a method for storing sheets of a photothermographic sheet material composed of a high-molecular weight compound support and a sensitive emulsion comprising, as the indispensable constituents, an organic silver salt oxidizing agent, a reducing agent for silver ion, a photosensitive silver salt compound or its precursor and a binder, characterized by inserting paper having smooth surfaces between every two sheets of said sheet material.

In this invention, sheets of a photothermographic sheet material are stored while contacting their emulsion surfaces with the surfaces of paper having smooth surfaces, and they are suitably stored under a pressure as small as possible, namely, at most 10 g/cm$^2$, preferably less than 5 g/cm$^2$. Most suitably, they are stored by alternately placing sheets of a photothermographic sheet material and sheets of paper having smooth surfaces face to face while allowing them to stand vertically on edge in a given direction so that substantially no pressure is applied to them. It is sufficient that the paper and the photothermographic sheet material may be partly in contact with each other, and they may be partly apart from each other, though it is desirable that they are close to each other within a certain distance, preferably a distance of less than 3 mm.

In this invention, the paper may be inserted at any time between the sheets of the photothermographic sheet material. It may be inserted between them at the time of winding the photothermographic sheet material obtained by coating a sensitive emulsion on a high-molecular weight compound support and then drying it. It may also be inserted after carrying out a certain treatment, for example, slit treatment after the coating and drying but before the winding.

In this invention, it is desirable that at least one sheet of the paper is inserted between every two sheets of the photothermographic sheet material. Other than this method, there may be employed, for example, a method by which the paper is folded in two and each sheet of the sheet material is inserted between the upper and lower halves of the folded paper, and the resulting assemblies are piled on one another; and a method by which each sheet of the sheet material is put into a paper bag and the resulting assemblies are piled on one another.

When inserting the paper, the amount of the remaining solvents contained in the sensitive emulsion layer is preferably not more than 15% by weight, more preferably not more than 7% by weight, based on the total amount of the sensitive emulsion layer.

In this invention, the paper is defined as being a thin layer having smooth surfaces produced by intertwining and/or gluing vegetable fibers, artificial fibers, synthetic fibers, and other fibers.

The kind of the paper used in this invention is not critical so long as the paper has smooth surfaces, and as the paper, there may be used quality paper, satin paper, gravure paper, art paper, coated paper, craft paper, glossy paper, tracing paper, roll paper, parchment paper, various laminated papers, and the like. In particular, there are preferred paper whose surfaces have been made smooth and glossy by calendering treatment or the like.

The smoothness of the paper suitable for this invention is 5 seconds or more as measured by means of a Bekk smoothness tester, JIS (Japanese Industrial Standard) P8119-1953. As the papers, there are preferably used those having a Bekk smoothness of 5 to 10,000 seconds, and more preferable are those having a Bekk smoothness of 200 to 5,000 seconds.

When the Bekk smoothness of the paper is less than 5 seconds, the paper is disadvantageous, for example, in that it is poor in smoothness, and hence, tends to impair the surfaces of the photothermographic sheet material, and in that the additives deposit on the interface between its portion in contact with the photothermographic sheet material and its portion out of contact with the photothermographic sheet material. When the Bekk smoothness exceeds 10,000 seconds, the paper has substantially no effect of improving the stability of the photothermographic sheet material. Moreover, blocking takes place between the sensitive emulsion layer of the photothermographic sheet material and the paper during storage for a long period of time.

The paper may be replaced by a suitable sheet material, such as a high polymer foam or the like, which has a smoothness of 5 to 10,000 seconds as measured by the above-mentioned Bekk Smoothness Test method and a permeability of tens to thousands of seconds as measured by means of a Gurlery permeability tester, JIS P8117-1952.

The paper which is most generally used in this invention has preferably a metric basis weight (a weight per square meter) of 5 to 200 g/m$^2$, more preferably 20 to 100 g/m$^2$.

The pH of the paper used in this invention is not critical, but a pH ranging from an acidic side to a weakly alkaline side is preferred for improving the storage stability of the photothermographic sheet material before being used. The pH of the paper can be measured by the method of JIS P8133.

As the photothermographic sheet material to which the storage method of this invention is applicable, there are most common those disclosed in U.S. Pat. No. 3,457,075, U.S. Pat. No. 3,802,888, U.S. Pat. No. 4,173,482, U.S. Pat. No. 4,113,496, U.S. Pat. No. 3,816,132, Japanese Pat. Publications Nos. 17898/78, 17415/77 and 41967/78 and the like. As the organic silver salt oxidizing agent used as one of the indispensable constituents of the sensitive emulsion in the photothermographic sheet material, silver salts of long-chain aliphatic carboxylic acids, such as silver behenate, silver stearate, silver laurate and the like, are most common. As the reducing agent capable of reducing the organic silver salt oxidizing agent, there are, for example, the so-called sterically hindered phenols. As the photosensitive silver salt compound, silver halides are most common. As the precursor of the photosensitive silver salt compound, there may be used N-halogeno compounds iodine molecule and bromine molecule, which react with suitable organic silver salt oxidizing agent only upon heating to form photosensitive seeds, such as silver halides; and cyanine dyes and merocyanine dyes which react directly with the organic silver salt compounds to form photosensitive seeds other than silver halides. As the binder, polyvinyl butyral, polymethyl methacrylate, polystyrene, and the like are particularly preferred.

The sensitive emulsion may be incorporated, besides the above-mentioned indispensable constituents, with various additives, for example, toning agents such as phthalazinone and the like; various halogen-containing organic compounds as anti-fogging agents; anti-thermofogging agents such as organic acid, mercury compounds, and the like; spectro-sensitizing dyes; antihalation dyes; various sensitizers; and the like.

The high-molecular weight compound support used in the photothermographic sheet material is not critical, so long as it is a generally used synthetic high polymer sheet, and as said support, there may be used, for example, polyethylene terephthalate film, polyvinyl acetate film, polyvinyl chloride film, polyvinyllidene chloride film, polyacrylonitrile film, and the like.

Further, the supports used in this invention may be those that have been subjected to various treatments, for example, they may have been previously provided with a subbing layer, or suitably subjected to heat treatment or electrostatic treatment.

Among the photothermographic sheet materials comprising the above-mentioned indispensable constituents, the effect of this invention is most remarkably exhibited in the post activation type photothermographic sheet materials whose volatile components are very difficult to control during drying and which are nonphotosensitive under room light conditions because the storage stability of these photothermographic sheet materials may be very greatly affected by the insertion of the paper.

As the so-called post-activation type photothermographic sheet materials, there may be used the compositions disclosed in U.S. Pat. No. 3,816,132, U.S. Pat. No. 3,764,329, U.S. Pat. No. 3,802,888, U.S. Pat. No. 4,173,482, Japanese Patent Publication No. 41,967/78 and the like.

As these post-activation type photothermographic sheet materials, there are known those containing a precursor of a photosensitive silver salt compound in which a photosensitive species is for the first time formed by preliminary heating, or those in which a compound inhibiting the photosensitivity of the photosensitive silver salt compound is eliminated at the preliminary heating step.

This invention is illustrated below referring to Examples, which are not by way of limitation but by way of illustration.

EXAMPLE 1

First of all, a thermo-development type photothermographic emulsion consisting of the constituents mentioned below was prepared. The preparation was carried out under safety light at about 24° C., and after the completion of addition of all the additives, agitation was conducted for about 1 hour to form an emulsion.

| | |
|---|---|
| Silver behenate | 200 g |
| Polyvinyl butyral resin | 180 g |
| Mercuric acetate | 0.4 g |
| Barium iodite | 8 g |
| Barium bromide | 2 g |
| Phthalazinone | 30 g |
| 2,2'-Methylenebis-(4-methyl-6-tert-butylphenol) | 120 g |
| Quinoline | 50 g |
| Methyl ethyl ketone | 2500 g |
| Toluene | 900 g |
| Methanol | 300 g |

The emulsion was uniformly coated on a polyester film of about 80 microns in thickness and 100 cm in width by means of a reverse roll coater while controlling the thickness of the coating so that the thickness of the coating after drying became be about 13 microns. The coated film was passed along a drying zone of about 15 m in length at a line speed of 10 m/min to be dried, and then wound. At this stage, the amount of the remaining solvents in the emulsion layer was 2.3% by weight based on the total weight of the emulsion layer.

Immediately after the winding, the photographic film wound was subjected to roll-back so that the surface of the sensitive emulsion layer of the film was contacted with a quality paper, whose surfaces have been made smooth and glazed by a calendering treatment (which paper had a Bekk smoothness of 360 seconds and a pH of 6.8 as measured by a test method according to the method of JIS P8133), and as a result, an assembly in which the photographic film was piled on the quality paper was obtained. The resulting assembly was passed through a slitter, and then wound in the state that the aforesaid paper was in intimate contact with the sensitive emulsion layer. The winding torque in this case was the minimum torque at which the winding was possible.

For comparision, exactly the same films as the aforesaid film were passed through a slitter and wound, without attaching paper thereto, in the state that the sensitive emulsion layer was directly in intimate contact with the back side of the film support.

In order to compare the stability during the storage prior to use for image formation of the films wound in the respective states, there were examined the photographic characteristics and appearances of the films after 12 hours from the coating and after the storage for 4 months at a temperature of 30° C. and a relative humidity of 80%.

A pressure of about 4 g/cm$^2$ was applied to the test portion of the wound films.

The photographic characteristics were measured by exposing the films to light of a tungsten lamp at 10,000 luxes for 2 seconds through a light wedge, and then developing them on a hot plate in the dark at 127° C. for 5 seconds to obtain a negative image.

The results obtained are shown in Table 1.

TABLE 1

| | 12 Hours after the coating | | | After the storage for 4 months at 30° C. and 80% of relative humidity | | | |
|---|---|---|---|---|---|---|---|
| | Photographic characteristics | | | Photographic characteristics | | | |
| | $OD_{max}$ | Sensitivity (log-$E_1$) | $OD_{min}$ | $OD_{max}$ | Sensitivity (log-$E_2$) | $OD_{min}$ | Appearance |
| Example (accompanied by paper) | 1.73 | 3.10 | 0.09 | 1.67 | 3.08 | 0.08 | No particular change |
| Comparative Example (not accompanied by paper) | 1.69 | 3.11 | 0.09 | 1.30 | 3.56 | 0.08 | Phthalazinone was deposited on the surface |

Note:
$OD_{max}$ = maximum optical density.
$OD_{min}$ = minimum optical density In Table 1, the sensitivity is expressed in terms of log E obtained from the exposure E(lux·sec) required to obtain the optical density of image of 1.

From the results shown above, the superiority of this invention is obvious. That is to say, in the case of the Comparative Example, the change of sensitivity $\Delta \log E = \log E_2 - \log E_1 = \log E_2/E_1 = 0.45$, which means that the exposure required after the storage for 4 months is approximately three times that 12 hours after the coating, and phthalazinone was deposited, while in the case of this invention substantially no change was found.

EXAMPLE 2

An emulsion of the following composition was prepared:

| | |
|---|---|
| Silver behenate | 80 g |
| Polyvinyl butyral | 70 g |
| Mercuric acetate | 2 g |
| Iodine | 5 g |

-continued

| | |
|---|---|
| Nickel acetylacetonate | 1 g |
| 1,2,3,4-Tetrabromobutane | 15 g |
| 2,3-Dimethyl-1-phenyl-3-pyrazoline-5-one (antipyrine) | 30 g |
| Toluene | 250 g |
| Methyl ethyl ketone | 800 g |
| Methanol | 100 g |

The emulsion was sufficiently mixed and then coated on a polyethylene terephthalate film having a thickness of about 50 microns to such a thickness that the thickness of the coating after drying became about 9 microns, after which the film was dried at a line speed of 12 m/min by using the same drying zone and drying temperature as in Example 1, and then wound.

Subsequently, a solution consisting of the constituents for the second layer mentioned below was uniformly coated on the first layer so that the thickness of the coating after drying became about 7 microns, and the film was dried at a line speed of 8 m/min under the same conditions as in the case of the first layer and then wound. At this stage, the amount of the remaining solvents was 1.8 % by weight of the whole emulsion layer.

| Constituents for the second layer | Amount |
|---|---|
| Phthalazinone | 13 g |
| 2,2'-Methylenebis-(4-ethyl-6-tert-butylphenol) | 40 g |
| Polymethyl methacrylate | 58 g |
| Methyl ethyl ketone | 700 g |

A roll of the photosensitive film was subjected to roll-back so that the surface of the emulsion layer of the film was contacted with an art paper (having a metric basis weight of 60 g/m$^2$ and a Bekk smoothness of 600 seconds), and an assembly in which the photographic film was piled on the art paper was obtained. The resulting assembly was continuously passed through a press to obtain a number of A-6 size sheets of the photographic film having the art paper on the surface of the emulsion layer. About 200 sheets of the film thus piled were stored with their emulsion layer upward in a darkroom under a uniform pressure of about 4.5 g/cm$^2$ for 7 months at a temperature of about 30° C. and a relative humidity of 80%.

In order to compare the stability of said film during the storage prior to use for image formation with that of the film alone, about 200 sheets of the latter film without paper were pounched out in the same manner as above, and piled on one another, and then stored under exactly the same conditions as in Example 2.

Since the photothermographic sheet material in this Example was normally non-sensitive, it was evaluated under the same conditions as in Example 1, except that they were preheated at about 100° C. for 3 seconds before the exposure to light, and then subjected to exposure through a mask film and heat development. The sampling of the film was effected by taking out 5 sheets from each of the lower, middle and upper layers of the pile of 200 sheets of the film, and the average value was obtained. The results are shown in Table 2. The expression of the sensitivity is the same as in Example 1.

TABLE 2

| | Evaluated on the day following the production of samples | | | Evaluated after the storage | | |
|---|---|---|---|---|---|---|
| | $OD_{max}$ | Sensitivity | $OD_{min}$ | $OD_{max}$ | Sensitivity | $OD_{min}$ |
| Example | 2.16 | 2.74 | 0.06 | 2.13 | 2.70 | 0.06 |
| Comparative Example | 2.21 | 2.72 | 0.06 | 1.63 | 3.51 | 0.14 |

It can be seen from the results shown above that the method of this invention is more useful and greatly improves the stability during the storage prior to use for image formation in the case of the thermodevelopment type photothermographic sheet material which is non-sensitive to common light as in the present Example.

EXAMPLE 3

The retention of sensitivity after the storage for 6 months at a temperature of 32° C. and a relative humidity of 75% in the same manner as in Example 2, except that the state that the pressure to be applied to the sensitive emulsion layer was varied is shown in Table 3. The retention of sensitivity is the ratio of the sensitivity (log $E_1$) immediately after the production of sample to the sensitivity (log $E_2$) after the storage.

The contact pressure was varied in the following manner. First, a rubber sheet of about 0.5 cm in thickness was placed on a horizontally fixed iron plate and a sample was put on the rubber sheet. A rubber sheet of about 0.5 cm in thickness having the same size as that of the sample was put on the sample, and a flat sheet of hard polyvinyl chloride of about 0.8 cm in thickness having the same size as above was put on the upper rubber sheet. A fixed weight of iron weights were put on the vinyl chloride sheet so that uniform load was applied on the resulting assembly in the above-mentioned state.

TABLE 3

| Pressure (g/cm$^2$) | Retention of sensitivity ($\log E_1/\log E_2$) |
|---|---|
| 2 | 1.01 |
| 5 | 0.99 |
| 10 | 0.98 |
| 15 | 0.93 |
| 25 | 0.84 |

Note:
The expression of the sensitivity is the same as in Example 1.

EXAMPLE 4

A sheet of the photographic film produced in exactly the same manner as in Example 2 was put into an envelope made of tracing paper (translucent paper which had been subjected to super-calendering and had a metric basis weight of 55 g/m$^2$ and a Bekk smoothness of 720 seconds), and about 100 sheets of the film each put in the envelope were allowed to stand vertically on edge, held between stainless steel plates so that a pressure of about 2 g/m$^2$ was uniformly applied thereto from both sides, and then stored in a darkroom for a year at a temperature of 30° C. and a relative humidity of 85%. The film sheets after the storage were evaluated under exactly the same conditions as in Example 2 to obtain the following results:

| | |
|---|---|
| $OD_{max}$ | 2.15 |
| Sensitivity | 2.72 |
| $OD_{min}$ | 0.06 |

The expression of the sensitivity is the same as in Example 1.

EXAMPLE 5

The relationship between the pH of various kinds of art paper and the storage stability were investigated to obtain the results shown in Table 4. The same film samples and storage conditions as in Example 2 were used. The pH of the various kinds of art paper was measured by JIS P8133.

TABLE 4

| pH | Retention of sensitivity ($\log E_1/\log E_2$) |
|---|---|
| 2.2 | 0.90 |
| 3.1 | 0.96 |
| 4.5 | 0.98 |
| 6.9 | 1.00 |
| 7.8 | 0.94 |
| 9.0 | 0.91 |
| 10.1 | 0.90 |

The expression of the sensitivity is the same as in Example 1.

What is claimed is:

1. A method for storing sheets of a photothermographic sheet material composed of a high molecular weight compound support and a sensitive emulsion comprising, as the indispensable constituents, an organic silver salt oxidizing agent, a reducing agent for silver ion, a photosensitive silver salt compound or its precursor, and a binder, characterized by inserting paper having smooth surfaces between every two sheets of said photothermographic sheet material.

2. A method according to claim 1, wherein the paper having smooth surfaces has a Bekk smoothness of 5 to 10,000 seconds.

3. A method according to claim 1, wherein the paper having smooth surfaces has a Bekk smoothness of 200 to 5,000 seconds.

4. A method according to claim 1, 2 or 3, wherein the pH of the paper having smooth surfaces ranges from 3 to 8.

5. A method according to claim 1, 2 or 3, wherein the photothermographic sheet material is non-sensitive to indoor light.

6. A method according to claim 1, 2 or 3, wherein the paper having smooth surfaces and the photothermographic sheet material are contacted with each other at a pressure of not more than 10 g/cm$^2$.

7. A method according to claim 6, wherein at least one sheet of the paper having smooth surfaces is inserted between every two sheets of the photothermographic sheet material so that the surface of the sensitive emulsion layer of the photothermographic sheet material is contacted with the paper having smooth surfaces.

8. A method according to claim 6, wherein each sheet of the photothermographic sheet material is inserted between the upper and lower halves of a folded sheet of the paper having smooth surfaces and the resulting assemblies are piled on one another.

9. A method according to claim 6, wherein each sheet of the photothermographic sheet material is put into a storing bag made of paper having smooth surfaces, and the bags are piled on one another.

10. A method according to claim 6, wherein sheets of paper having smooth surfaces or bags made thereof and sheets of the photothermographic sheet material are alternately placed face to face under a pressure as small as possible while allowing them to stand vertically on edge in a given direction, and are stored in said state.

11. A method according to claim 4, wherein the paper having smooth surfaces and the photothermographic sheet material are contacted with each other under a pressure of not more than 10 g/cm$^2$.

12. A method according to claim 5, wherein the paper having smooth surfaces and the photothermographic sheet material are contacted with each other under pressure of not more than 10 g/cm$^2$.

13. A method according to claim 7, wherein sheets of paper having smooth surfaces or bags made thereof and sheets of the photothermographic sheet material are alternately placed face to face under a pressure as small as possible while allowing them to stand vertically on edge in a given direction, and are stored in said state.

14. A method according to claim 8, wherein sheets of paper having smooth surfaces or bags made thereof and sheets of the photothermographic sheet material are alternately placed face to face under a pressure as small as possible while allowing them to stand vertically on edge in a given direction, and are stored in said state.

15. A method according to claim 9, wherein sheets of paper having smooth surfaces or bags made thereof and sheets of the photothermographic sheet material are alternately placed face to face under a pressure as small as possible while allowing them to stand vertically on edge in a given direction, and are stored in said state.

* * * * *